United States Patent [19]

Van Hecke et al.

[11] 4,211,754

[45] Jul. 8, 1980

[54] PROCESS FOR THE PRODUCTION OF A TANTALUM AND NIOBIUM BEARING CONCENTRATE FROM A TANTALUM AND NIOBIUM BEARING FERRO-ALLOY

[75] Inventors: Michel C. F. Van Hecke, Aartselaar; Jean Deweck, Brussels, both of Belgium

[73] Assignee: Metallurgie Hoboken-Overpelt, Brussels, Belgium

[21] Appl. No.: 951,113

[22] Filed: Oct. 13, 1978

[30] Foreign Application Priority Data

Oct. 19, 1977 [LU] Luxembourg ..... 78341

[51] Int. Cl.[2] ..... C01G 33/00; C01G 35/00

[52] U.S. Cl. ..... 423/62; 75/24; 75/84

[58] Field of Search ..... 423/62; 75/24, 84, 57

[56] References Cited

U.S. PATENT DOCUMENTS

| | | | |
|---|---|---|---|
| 2,140,801 | 12/1938 | Leemans et al. | 423/62 |
| 2,972,530 | 2/1961 | Zimmerley et al. | 423/62 |
| 3,057,714 | 10/1962 | Back et al. | 423/62 |
| 3,091,524 | 5/1963 | Johnson | 75/24 |
| 3,447,894 | 6/1969 | Gustison et al. | 423/68 |
| 3,585,024 | 6/1971 | Cenerazzo et al. | 75/24 |
| 3,721,727 | 3/1973 | Gustison | 423/62 |

FOREIGN PATENT DOCUMENTS

| | | | |
|---|---|---|---|
| 834105 | 11/1938 | France | 423/62 |
| 834602 | 11/1938 | France | 423/62 |

*Primary Examiner*—Herbert T. Carter
*Attorney, Agent, or Firm*—Fred Philpitt

[57] ABSTRACT

A tantalum and niobium bearing concentrate is produced from a tantalum and niobium bearing ferro-alloy, containing tantalum and niobium as carbide, by treating the ferro-alloy in molten state with a controlled amount of an oxidizing agent such as oxygen in order to slag tantalum and niobium, and by separating the so obtained slag phase from the metal phase. The ferro-alloy contains enough iron to have at least most of the tantalum carbide dissolved in the molten ferro-alloy.

9 Claims, 1 Drawing Figure

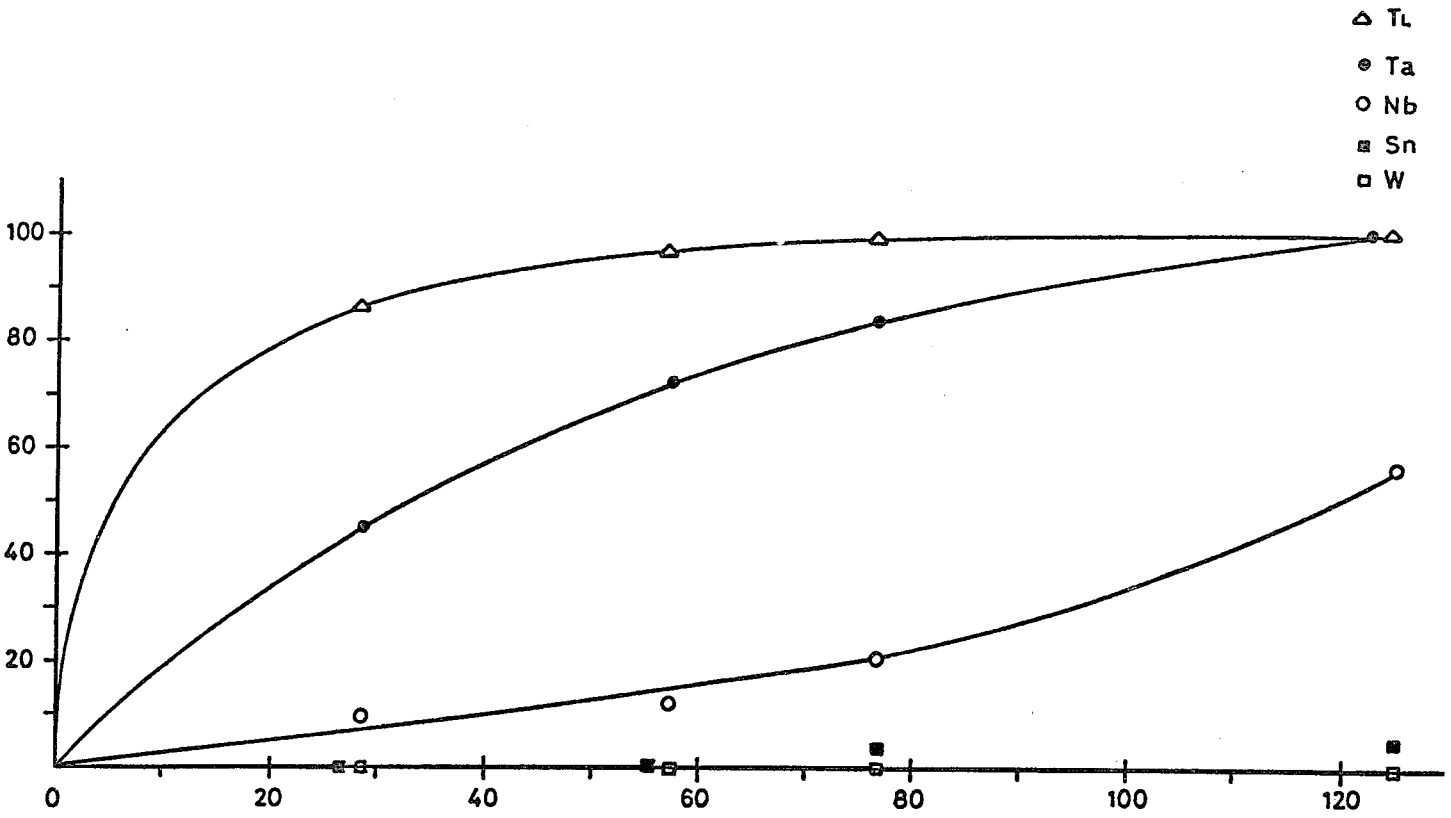
Tl
Ta
Nb
Sn
W
100
80
60
40
20
0
20
40
60
80
100
120

PROCESS FOR THE PRODUCTION OF A TANTALUM AND NIOBIUM BEARING CONCENTRATE FROM A TANTALUM AND NIOBIUM BEARING FERRO-ALLOY

The present invention relates to a process for the production of a tantalum and niobium bearing concentrate from a tantalum and niobium bearing ferro-alloy, containing tantalum and niobium as carbide, in which process the ferro-alloy is treated in molten state with a controlled amount of an oxidizing agent in order to slag at least most of the tantalum and at least part of the niobium and the so obtained slag phase is separated from the metal phase. The ferro-alloy may contain other elements such as Ti, Sn and W, possibly as carbide. Such a ferro-alloy is normally obtained by reducing smelting, in the presence of carbon, of tin slags or other metallurgical by-products containing tantalum, niobium and iron in the oxidized state. The obtained tantalum and niobium bearing concentrate can be used to feed a tantalum and niobium manufacturing plant applying the wet process.

A process of the above kind has been described in the U.S. Pat. No. 3,721,727. This known process relates to the treatment of a strongly concentrated ferro-alloy (19% iron in weight), obtained by reduction of tin slags in an electric furnace. According to this known process, elements that are more easily oxidizable than tantalum, such as Si and Ti, are slagged in a first step, and tantalum and niobium in a second step. The first step consists of crushing the ferro-alloy, mixing the crushed ferro-alloy with a controlled amount of a metal oxide capable of oxidizing the silicon, such as hematite, melting this mixture and separating the so produced slag phase from the ferro-alloy phase. The second step consists in crushing the ferro-alloy phase resulting from the first step, mixing this crushed phase with a controlled amount of a metal oxide capable of oxidizing the tantalum and niobium, such as hematite, melting this mixture, and separting the so produced tantalum and niobium bearing slag phase from the depleted ferro-alloy phase. In the second step is thus obtained a slag with a $Ta_2O_5$ content ranging between 19 and 21.4% and a $Nb_2O_5$ content between 24.1 and 25.7%. The depleted ferro-alloy still contains 2.9% Ta and 1.5% Nb, both expressed as their pentoxides. In the case of a single step process i.e. when enough hematite is added to the original ferro-alloy feed to slag the tantalum and niobium, which in fact is against what is expressely advised in the patent, the slag obtained has a $Ta_2O_5$ content varying only between 12.6 and 13.3% and a $Nb_2O_5$ content only between 13.1 and 14.8%. The patent mentions the possibility to use, in the second step, oxygen instead of a metal oxide as an oxidizing agent. The use of oxygen, however, is not described in the specific examples given in the patent.

The main object of the present invention is to provide a process, which is more simple and more economical than the above mentioned prior art process, in particular a process requiring neither the use of a solid oxidizing agent, that by nature is not very reactive, nor a two step slagging and assuring better recovery of tantalum and, if wished, of niobium.

Another object of the present invention is to provide such a process allowing, moreover, the obtaining of a purer tantalum and niobium bearing concentrate than the one obtained by the above mentioned prior art process.

For this purpose, according to the invention, use is made of a ferro-alloy containing enough iron to have at least most of the tantalum carbide dissolved in the molten ferro-alloy.

It has indeed been found that tantalum and niobium can be slagged much more easily in such a ferro-alloy than in the previously used concentrated ferro-alloys.

As already mentioned before, the ferro-alloys to which the present patent application relates, result normally from smelting, in presence of carbon, tin slags or other metallurgical by-products, containing tantalum, niobium and iron in an oxidized state. Such smelting produces normally a concentrated ferro-alloy that can not be used in the process of the invention. In order to obtain the ferro-alloy used according to the process of the present invention, said smelting can be carried out in the presence of an appropriated amount of iron or iron oxide. It is, however, much more advantageous to produce a concentrated ferro-alloy by smelting, as was done up to now, and to dilute afterwards this concentrated ferro-alloy with an appropriate amount of iron, preferably iron with a carbon content lower than 1% in weight. Normally, said amount of iron will at least reach 70% in weight, preferably at least 200% in weight of the concentrated ferro-alloy.

In the process of the present invention just as in the above mentioned prior art process, a metal oxide capable of oxidizing tantalum and niobium can be used as the oxidizing agent. It is, however, much more advantageous to make use of air, oxygen enriched air or oxygen as the oxidizing agent. Such an oxidizing agent is advantageously blown into the metal phase. It is also possible to blow such an oxidizing agent on the surface of the molten bath, in which case the bath should be stirred.

It should be noted that in the process of the present invention tantalum is more rapidly slagged than niobium. It is thus possible to slag only most of the tantalum when, for whatever reason, the recovery of niobium is not wanted.

When the ferro-alloy contains Ti, Sn and/or W, most of Ti is first slagged, followed by most of the tantalum and at least part of the niobium, while most of Sn and W is left in the metal phase. Although it is not necessary to make use of this selective slagging phenomenon to obtain a high-grade tantalum and niobium bearing concentrate, as will be shown below, it may however be useful to separate in several steps the slag phase from the metal phase, e.g. a Ti-rich slag in a first step and a Ta- and Nb-rich slag in a second step. This Ti-rich slag, which also contains tantalum, may be recycled to the ferro-alloy production stage, where most of the Ti is slagged and tantalum is collected in the ferro-alloy.

The process of the invention and its advantages are illustrated by the four comparative tests described below.

Test No. 1 relates to the blowing of oxygen into a molten bath of concentrated ferro-alloy obtained by smelting with coke a tin slag, the ferro-alloy showing following composition (in percentage of weight): 10.23 Ta, 7.03 Nb, 6.44 Si, 57.58 Fe, 2.87 Ti, 5.38 Sn, 2.39 W, 2.8 C, 1 CaO, 1.5 Mn, 2 $Al_2O_3$.

Test No. 2 relates to the blowing of oxygen into a molten bath with 50% by weight of ferro-alloy, having the same composition as in test No. 1, and 50% in weight of mild steel.

Test No. 3 relates to the blowing of oxygen into a molten bath with 25% by weight of ferro-alloy having the same composition as in tests No. 1 and No. 2, and 75% in weight of mild steel.

Test No. 4 relates to the blowing of oxygen into a molten bath with 25% by weight of concentrated ferro-alloy and 75% by weight of mild steel, the concentrated ferro-alloy having the following composition (in percentage of weight): 11.44 Ta, 7.28 Nb, 7.88 Si, 4Ti, 3.64 Sn, 2.04 W, 2.62 Mn, 55.96 Fe, 2.64 C, 1 CaO, 1.5 $Al_2O_3$.

A metallographic assay of samples of these molten baths, having been immediately quenched after their taking, shows that in the molten bath of test No. 1, most of the tantalum carbide is present in solid state, whereas in the other molten baths tantalum carbide is substantially present in dissolved state.

The four tests are carried out on 2.5 kg of molten bath, the temperature of which reaches 1,550° C. The molten bath is contained in a graphite crucible, placed in an electric furnace. Oxygen is blown into the molten bath by an $Al_2O_3$ lance at a rate of 114 g per hour or 80 liters per hour. From time to time a sample is taken from the metal phase and from the slag phase.

Tables 1, 2, 3 and 4 hereafter give the evolution of the composition (in percentage of weight) by the metal phase versus the injected quantity of oxygen, respectively during the tests No. 1, No. 2, No. 3 and No. 4.

Tables 5, 6, 7 and 8 hereafter give the evolution of the composition (in percentage by weight) of the slag phase versus the injected quantity of oxygen, respectively during the tests No. 1, No. 2, No. 3 and No. 4.

BRIEF DESCRIPTION OF DRAWING

The diagram of the accompanying FIGURE, based on the balance of materials made up for test No. 3, shows on the ordinate, the slagged ponderal fraction (in percentage) of the Ti, Ta, Nb, Sn and W elements and on the abscissa, the weight (in grams) of the injected oxygen.

Table 1

| liters of injected $O_2$ | Ta | Nb | Si | Fe | Ti | Sn | W |
|---|---|---|---|---|---|---|---|
| 0 | 10.23 | 7.03 | 6.44 | 57.58 | 2.87 | 5.38 | 2.39 |
| 60 | 5.8 | 4.27 | 7.11 | 66.63 | 1.82 | 4.93 | 2.46 |
| 120 | 6.09 | 4.73 | 5.34 | 66.61 | 1.46 | 4.65 | 2.84 |
| 160 | 3.54 | 3.46 | 4.56 | 73.95 | 0.62 | 5.65 | 3.06 |
| 200 | 5.48 | 4.6 | 3.27 | 72.3 | 0.7 | 5.42 | 3.13 |

Table 2

| liters of injected $O_2$ | Ta | Nb | Si | Fe | Te | Sn | W |
|---|---|---|---|---|---|---|---|
| 0 | 5.03 | 3.56 | 2.43 | 81.66 | 0.93 | 1.9 | 1.2 |
| 60 | 5.11 | 3.94 | 1.87 | 81.54 | 0.74 | 2.04 | 1.25 |
| 120 | 4.54 | 4.20 | <0.2 | 83.22 | 0.52 | 2.22 | 1.28 |
| 160 | 1.28 | 2.63 | 0.35 | 88.59 | 0.08 | 2.37 | 1.4 |

Table 3

| liters of injected $O_2$ | Ta | Nb | Fe | Ti | Sn | W |
|---|---|---|---|---|---|---|
| 0 | 2.99 | 2.07 | 87.84 | 0.75 | 1.05 | 0.67 |
| 20 | 1.76 | 1.89 | 91.97 | 0.14 | 1.09 | 0.55 |
| 40 | 0.83 | 1.94 | 90.81 | 0.03 | 1.11 | 0.57 |
| 53 | 0.55 | 2.00 | 94.13 | <0.02 | 1.19 | 0.63 |
| 88 | <0.02 | 1.26 | 95.77 | <0.02 | 1.18 | 0.57 |

Table 4

| liters of injected $O_2$ | Ta | Nb | Si | Fe | Ti | Sn | W | Mn |
|---|---|---|---|---|---|---|---|---|
| 0 | 2.86 | 1.82 | 1.97 | 88.99 | 1.0 | 0.91 | 0.51 | 0.63 |
| 23 | 1.98 | 2.32 | 0.95 | 90.46 | <0.05 | 0.98 | 0.56 | 0.26 |
| 45 | 1.23 | 2.32 | 0.87 | 91.67 | <0.05 | 1.02 | 0.63 | 0.15 |
| 91 | <0.05 | 1.01 | 0.19 | 95.33 | <0.05 | 1.02 | 0.60 | <0.05 |
| 136 | 0.13 | 0.08 | 0.23 | 95.42 | <0.05 | 1.07 | 0.59 | <0.05 |

Table 5

| liters of injected $O_2$ | $Ta_2O_5$ | $Nb_2O_5$ | $SiO_2$ | FeO | $TiO_2$ | Sn | W |
|---|---|---|---|---|---|---|---|
| 160 | 10.82 | 7.45 | 28.27 | 38.23 | 10.38 | 2.92 | 1.89 |
| 200 | 10.44 | 6.49 | 37.66 | 26.63 | 13.99 | 2.39 | 1.29 |

Table 6

| liters of injected $O_2$ | $Ta_2O_5$ | $Nb_2O_5$ | $SiO_2$ | FeO | $TiO_2$ | Sn | W |
|---|---|---|---|---|---|---|---|
| 120 | 20.19 | 7.44 | 37.38 | 11.19 | 12.58 | 0.25 | <0.06 |
| 160 | 25.11 | 10.92 | 28.75 | 15.11 | 11.33 | 0.37 | 0.2 |

Table 7

| liters of injected $O_2$ | $Ta_2O_5$ | $Nb_2O_5$ | $SiO_2$ | FeO | $TiO_2$ | Sn | W |
|---|---|---|---|---|---|---|---|
| 40 | 28.98 | 4.2 | 34.98 | 5.02 | 15.73 | 0.1 | <0.05 |
| 88 | 25.22 | 14.31 | 28.23 | 13.58 | 9.56 | 0.4 | 0.05 |

Table 8

| liters of injected $O_2$ | $Ta_2O_5$ | $Nb_2O_5$ | $SiO_2$ | FeO | $TiO_2$ | Sn | W. MnO | |
|---|---|---|---|---|---|---|---|---|
| 23 | 25.44 | 1.43 | 21.77 | 11.76 | 31.06 | <0.05 | <0.05 | 8.44 |
| 45 | 29.74 | 2.66 | 28.85 | 7.73 | 22.31 | <0.05 | <0.05 | 8.72 |
| 91 | 26.32 | 12.3 | 29.47 | 12.64 | 13.02 | <0.05 | <0.05 | 6.26 |
| 136 | 19.78 | 14.81 | 22.40 | 28.46 | 9.97 | <0.05 | <0.05 | 4.75 |

Tables 1 and 5 show that the slagging of tantalum is far from complete and selective in test No. 1.

Tables 2 and 6 show that test No. 2 gives a much more selective slagging of tantalum than test No. 1. This easier slagging of tantalum is still more distinctly shown in tests No. 3 and No. 4, as it appears from tables 3, 4, 7 and 8. Test No. 3 gives, after nearly complete slagging of tantalum, a slag with still 25.22% $Ta_2O_5$. The slag obtained in test No. 4 still contains 19.78% $Ta_2O_5$ after nearly complete slagging of tantalum and niobium.

The selectivity of the slagging obtained in test No. 3 results clearly from the accompanying figure.

We claim:

1. In a process for the production of a tantalum and niobium bearing concentrate from a tantalum and niobium bearing ferro-alloy containing tantalum and niobium as carbide, by treating the ferro-alloy in molten state with a controlled amount of an oxidizing agent in order to slag at least most of the tantalum and at least part of the niobium and by separating the so obtained slag phase from the metal phase, the improvement which comprises using air, oxygen enriched air or oxygen as oxidizing agent and adjusting the iron content of the ferro-alloy by adding at least 70% by weight of iron prior to the step of forming the slag so that at least most of the tantalum carbide is dissolved in the molten ferro-alloy.

2. A process according to claim 1 wherein said ferro-alloy is produced by adding iron to a ferro-alloy less rich in iron that will not dissolve most of the tantalum carbide.

3. A process according to claim 2 wherein the ferro-alloy less rich in iron is produced by smelting with carbon, tin slags or other metallurgical by-products, containing tantalum, niobium and iron in oxidized state, and at least 70% by weight of iron is added to the so obtained ferro-alloy.

4. A process according to claim 3 wherein at least 200% by weight of iron is added.

5. A process according to claim 2 wherein said iron has a carbon content lower than 1% in weight.

6. A process according to claim 1 wherein said ferro-alloy contains at least one of the elements Ti, Sn and W and most of the Ti is first slugged and afterwards most of the tantalum and at least part of the niobium, thus leaving most of the Sn and W in the metal phase.

7. A process according to claim 6 wherein the slag is separated from the metal phase in several steps.

8. A process according to claim 1 wherein the oxidizing agent is blown into the metal phase.

9. A process according to claim 1 wherein said ferro-alloy is produced by smelting with carbon and a controlled amount of iron or iron oxide, tin slags or metallurgical by-products, which contain tantalum, niobium and iron in oxidized state.

* * * * *